US005205252A

United States Patent [19]

Krepela

[11] Patent Number: 5,205,252

[45] Date of Patent: Apr. 27, 1993

[54] ENGINE AIR SHUTDOWN VALVE

[75] Inventor: Joseph Krepela, Edmonton, Canada

[73] Assignee: Barber Industries Ltd., Calgary, Canada

[21] Appl. No.: 725,290

[22] Filed: Jun. 13, 1991

[51] Int. Cl.[5] ..... F02D 9/08

[52] U.S. Cl. ..... 123/198 D; 123/198 DB; 251/68

[58] Field of Search ... 123/198 D, 198 DB, DIG. 11; 251/66, 68, 70, 74

[56] References Cited

U.S. PATENT DOCUMENTS

| | | | |
|---|---|---|---|
| 2,304,844 | 12/1942 | Parker et al. | 251/68 |
| 3,385,559 | 5/1968 | Churchill | 251/74 X |
| 3,463,443 | 8/1969 | Churchill | 251/70 |
| 3,463,444 | 8/1969 | Churchill | 251/70 |
| 3,463,445 | 8/1969 | Churchill | 251/70 |
| 3,620,204 | 11/1971 | Baltadonis | 123/198 D |
| 4,092,970 | 6/1978 | Ball et al. | 123/198 DB X |
| 4,215,845 | 8/1980 | Sturgeon . | |
| 4,285,494 | 8/1981 | Sturgeon . | |
| 4,422,418 | 12/1983 | Dorn | 123/198 D |
| 4,501,238 | 2/1985 | Odum | 123/198 D |
| 4,537,386 | 8/1985 | Krepela et al. . | |

*Primary Examiner*—Gerald A. Michalsky
*Attorney, Agent, or Firm*—John Russell Uren

[57] ABSTRACT

An engine air shutdown valve comprising a gate which is movable from a first position wherein the air flow passage of an engine is relatively unimpeded to a second position where the air flow passage is closed thereby terminating operation of the engine. A trip spindle maintains the gate in its open position with a ball release. Upon activation of the ball release, the gate moves parallel to the direction of air flow through the passage to terminate the air flow.

9 Claims, 3 Drawing Sheets

ENGINE AIR SHUTDOWN VALVE

INTRODUCTION

This invention relates to an engine air shutdown valve and, more particularly, to an engine air shutdown valve of the poppet type which is used to terminate the air flow of a diesel engine thereby to terminate its operation.

BACKGROUND OF THE INVENTION

Engine shutdown valves are known and are specifically used to shut down engines so as to prevent over revving of the engine and the concomitant damage which can result and to terminate unsafe operations. Over revving of the engine can result when fuel or gas vapours which may be present in the atmosphere around the engine enter the air intake of the engine, thereby allowing combustion and continued operation of the engine even though the diesel fuel has been shut off.

One such engine shutdown valve is disclosed in our U.S. Pat. No. 4,537,386 entitled ENGINE SHUTDOWN VALVE. The valve there disclosed is specifically designed for the swing arm type application where minimal room is available along the air passage. The gate valve moves transverse to the direction of air flow in the '386 patent during its closing action.

A further shutdown valve is disclosed in our U.S. Pat. Nos. 4,215,845 and 4,285,494, both entitled ENGINE AIR CUT-OFF DEVICE. These patents both teach a shut down valve wherein the gate again moves transversely to the direction of air flow through the manifold and into the engine as in the '386 patent. The closure action, however, is not a pivoting actions as in the '386 patent. Rather, it is a linear motion which is useful in certain circumstances.

SUMMARY OF THE INVENTION

According to one aspect of the present invention, there is provided an engine air shutdown valve comprising a housing, a gate movable relative to said housing and parallel to the axis of the air intake of an engine, a gate spring mounted between said housing and said gate for biasing said gate to move away from said housing in a first locked position, means for maintaining said gate in said first locked position and means for releasing said gate maintaining means such that said gate moves relative to and away from said housing under the influence of said gate spring.

According to a further aspect of the invention, there is provided a method of shutting off the air supply of an engine comprising the steps of:

(a) positioning a gate in a first open position adjacent to the sealing face of an air flow passage of said engine;

(b) maintaining said gate in said open position under the influence of a spindle;

(c) initiating operation of said spindle to allow movement of said gate in a direction parallel to the direction of air flow through said air flow passage from said open to a closed position wherein said gate contacts said sealing face and closes said air flow passage.

BRIEF DESCRIPTION OF THE SEVERAL VIEWS OF THE DRAWINGS

An embodiment of the invention will now be described, by way of example only, with the use of drawings in which.

DESCRIPTION OF SPECIFIC EMBODIMENT

Figure 1:
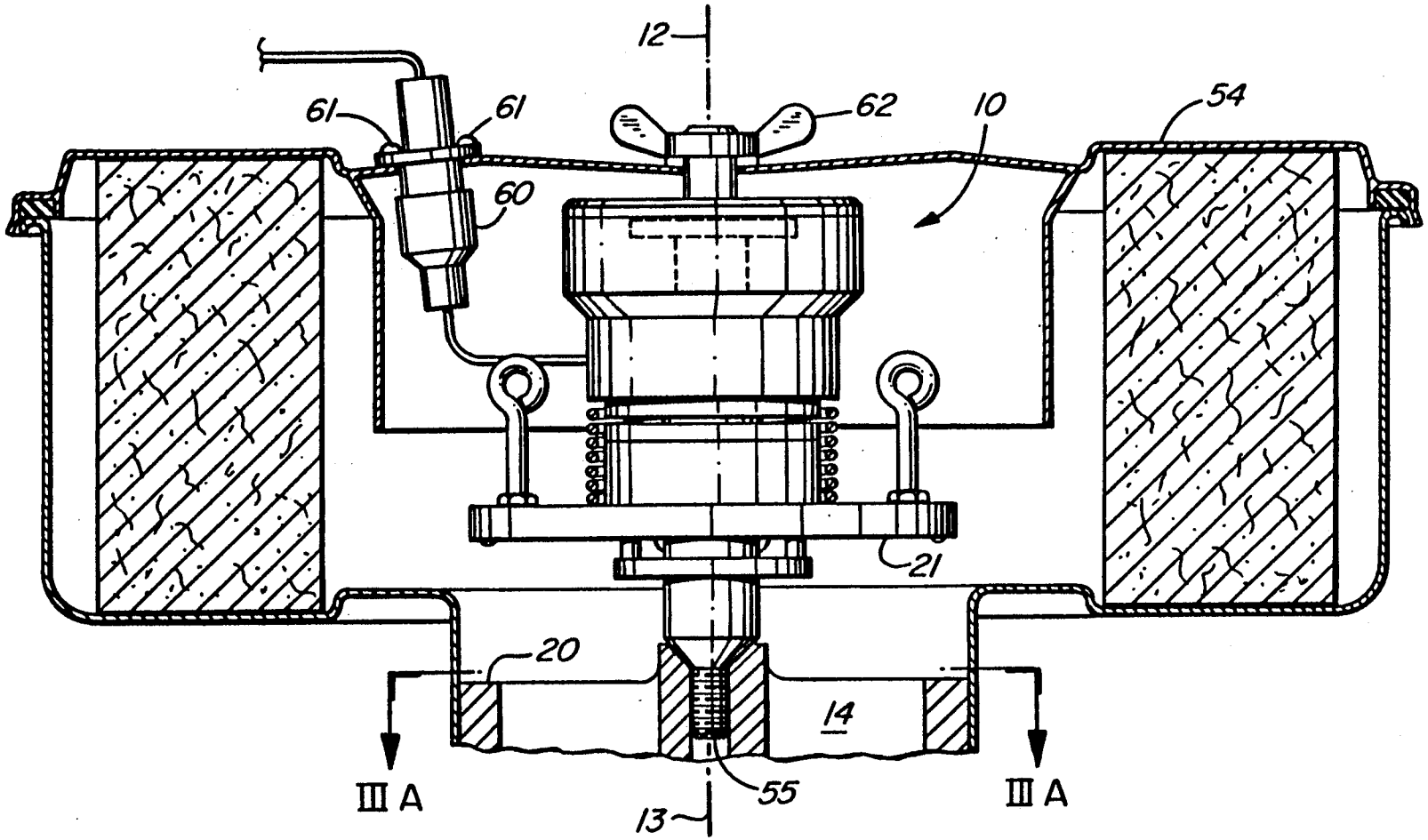
FIG. 1 is a side elevation view of one embodiment of the engine shutdown valve according to the invention in its operating position within the air cleaner of an engine and parallel to the axis of the air flow passage into the engine.
Figure 3A:
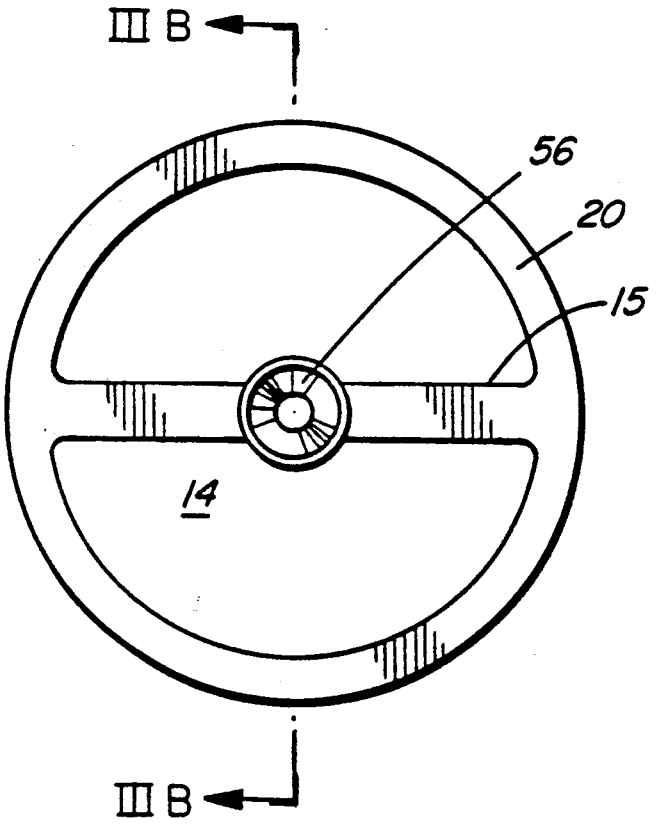
FIG. 3A is a plan view of the engine inlet taken along the lines IIIA—IIIA of FIG. 1.
Figure 3B:
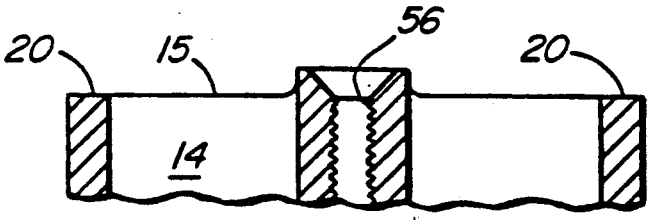
FIG. 3B is a sectional view taken along IIIB—IIIB of FIG. 3A.

Referring now to the drawings, an engine shutdown valve according to the invention is illustrated generally at 10 in FIG. 1. It is installed within the air cleaner generally illustrated at 11 and has an axis 12 which is generally parallel and conveniently coaxial with the axis 13 of the air flow passage 14 into the engine. The air flow passage 14 has a cylindrical sealing face 20 (also illustrated in FIG. 3) and a ridge 15 extending therebetween which sealing face 20 is intended to contact the gate 21 of the engine shutdown valve 10 in a manner to be explained in greater detail hereafter.

Figure 2:
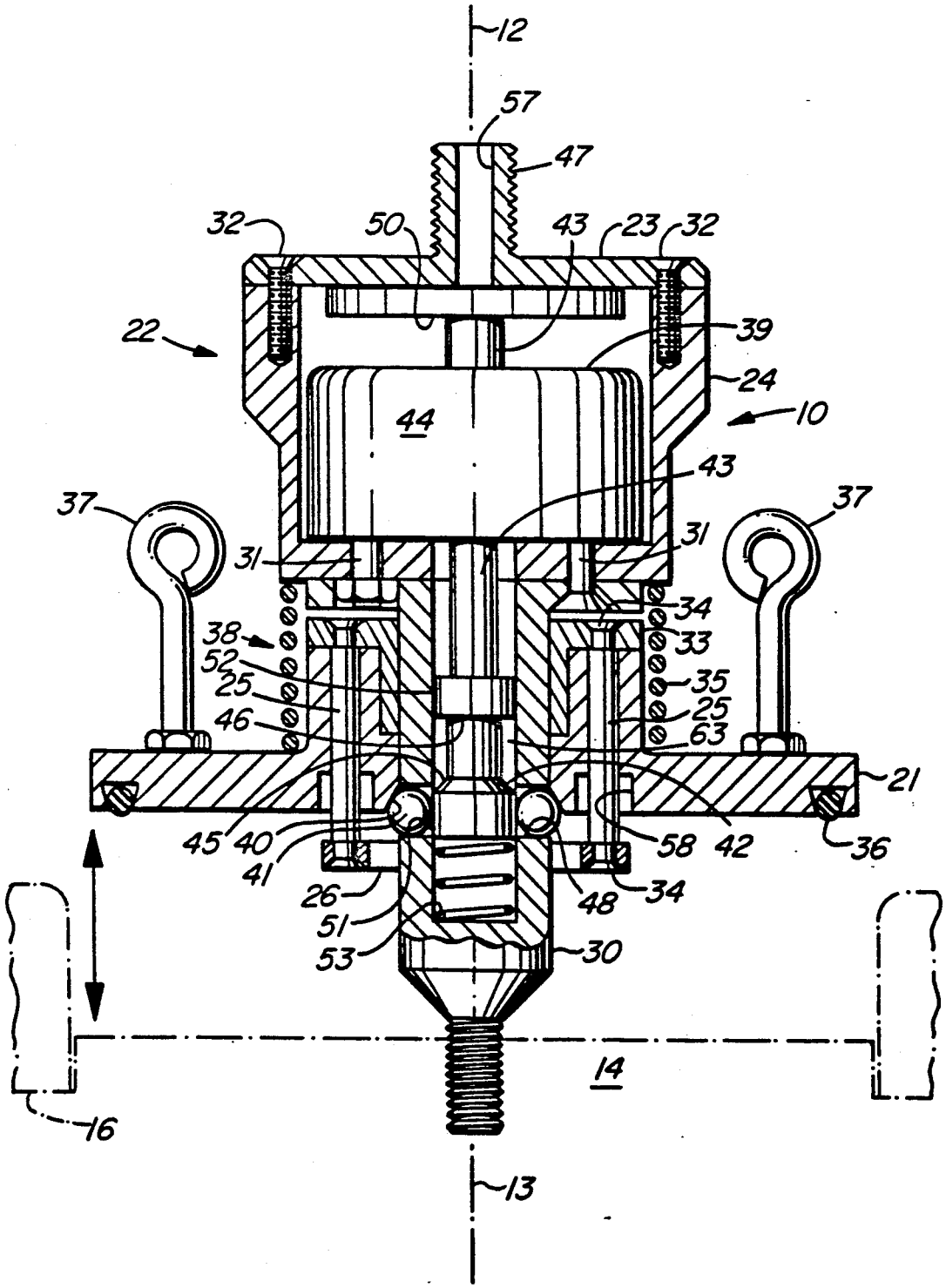
FIG. 2 is a side sectional view of the engine shutdown valve of FIG. 1, drawn to a larger scale.

The engine shutdown valve 10 is shown more clearly in section in FIG. 2. It comprises a body generally illustrated at 22 which comprises a cover 23 and a cylindrical body portion 24. A keeper 30 is connected to cylindrical body portion 24 by capscrews 31. Cover 23 is connected to body portion 24 using capscrews 32.

The gate 21 of shutdown valve 10 is part of the gate assembly generally illustrated at 38. Two rods 25 are connected to a sleeve 33 by rivets 34 and extend through the gate 21 to a retainer 26 where the rods 25 are connected by rivets 34. The gate 21 of the gate assembly 38 may thereby move relative to the rods 25 and the sleeve 33 as will be explained in greater detail hereafter. Sleeve 33 and gate 21 are adapted to move longitudinally and relative to the keeper 30 along axis 13. A gate spring 35 extends between the gate 21 and the cylindrical body portion 24 as illustrated. Gate spring 35 acts to bias the gate 21 downwardly as viewed in FIG. 2 or away from the body portion 24.

An 0-ring 36 is provided inside the outside periphery of cylindrical gate 21. 0-ring 36 acts to seal the gate 21 against the sealing face 20 (FIG. 1) when the operation of shutdown valve 10 is initiated and the valve 10 is in its triggered position.

Two eyelets 37 are connected to the gate 21. They may be utilised to open the gate 21 following operation of the shutdown valve 10 when the air flow passage 14 is closed by the action of the gate 21 against the sealing face 20 (FIG. 1).

The gate 21 has a bevelled inside portion 40 adapted to contact the balls 41 protruding from the keeper 30 under the bias of a trip spindle 42 when the gate 21 is in its open or untriggered position. The balls 41 maintain the gate 21 in the open position as will be set out in more detail hereafter.

The trip spindle 42 is longitudinally movable and is mounted within the keeper 30 of the engine shutdown valve 10 and is coaxial with axis 13. The plunger 43 of the solenoid generally illustrated at 44 bears on the end of spindle 42 and provides longitudinal movement of the spindle 42 when the plunger 43 moves responsive to the action of the coil 39 which will attract collar 50 and thereby move plunger 43 and spindle 42 as described in greater detail hereafter.

Spindle 42 has two shoulder portions 51, 52, shoulder 51 having a camfered upper edge 45 and shoulder 52 having a square lower edge 46, the purposes of which will be described in greater detail hereafter. A spindle spring 53 is mounted within the keeper 30 and below the trip spindle 42. It acts to bias the trip spindle 42 upwardly.

With reference again to FIG. 1, the shutdown valve 10 is mounted within the engine air cleaner generally illustrated at 11. The cover 54 is removed and the lower threaded male portion 55 is screwed into the female receptacle 56 (FIG. 3) which previously held the tie rod (not shown) of the air cleaner 11. The cover 54 then has a ¾" hole drilled as indicated to allow installation of the electric plug assembly 60. Two self tapping screws 61 are provided to connect the electric plug assembly 60 to the aircleaner cover 54 and to the solenoid connection (not shown) on the shutdown valve 10. The air cleaner cover 54 is then reinstalled and a wingnut 62 is connected to the threaded outer periphery 47 (FIG. 2) of cover 23. The electric plug assembly 60 is then connected to a 12–24 volt D.C. power source.

OPERATION

In operation, the shutdown valve 10 will be the position illustrated within the air cleaner 11 in FIG. 1 until an unsafe condition exists and it is desired to quickly terminate the operation of the engine. That is, the gate 21 will be located some distance from the sealing face 20 of the air passage 14 such that it does not interfere with the normal flow of air into the engine when normal engine operation is occurring.

Two techniques are provided to initiate the operation of the shutdown valve 10 when an unsafe condition exists. The first utilises the action of the solenoid 44. A source of power is provided to the solenoid 44 from the plug assembly 60. This initiates downwards operation of the collar 50 and plunger 43 which, in turn, moves the trip spindle 42 downwardly against the biasing action of the spindle spring 53.

As the trip spindle 42 moves downwardly, the balls 41 will move inwardly over camfer 45 as shoulder 51 moves downwardly and away from the ball recess 48 extending through the walls of the keeper 30 until the balls 41 contact the outside of the trip spindle 42 in the recessed area 63 between shoulders 51, 52. Since there is no longer support provided to the gate 21 by the balls 41, the gate 21 will immediately move downwardly with retainer 26 under the influence of gate spring 3 and relative to the keeper 30 until the retainer 26 first bottoms on the ridge 15 extending between the sealing faces 20 and stops. The gate 21 will continue downwardly relative to and over rods 25 under the influence of gate spring 35 until 0-ring 36 on gate 21 contacts the sealing face 20 of the air flow passage 14. The retainer 26 will then be in a position within the recess 58 in gate 21. The contact of the gate 21 with the sealing face 20 will immediately terminate air flow and the operation of the engine will cease.

The balls 41 will remain in the recess 63 of the trip spindle 42 and the ball recess 48 of keeper 30, the latter in which they move normal to the axis 13 of the trip spindle 42. The trip spindle 42, acting under the influence of spindle spring 53 will bias the balls 41 outwardly on the camfer area 45 adjacent shoulder 51. The balls 41, however, will contact the inside periphery of the sleeve 33 or gate 21 and will be unable to move further outwardly until the gate 21 is restored to its normal or untripped position.

A second technique used to initiate operation of the shutdown valve 10 is to simply insert an object such as a rod or screwdriver (not shown) into the hole 57 extending through the threaded periphery 47 of the cover 23 and the to press the rod downwardly. This performs precisely the same function as does the operation of the solenoid 44 with the result that the spindle 42 will move downwardly thereby releasing the gate 21 which will move downwardly relative to keeper 30 until the 0-rings 36 on gate 21 again contact the sealing face 20 of the air flow passage as previously explained. The engine operation will likewise immediately terminate.

In order to reset the shutdown valve 10 after operation, the air cleaner cover 54 is removed and the gate 21 is pulled up utilising the eyelets 37 or otherwise as the gate 21 moves against the force of the gate spring 35. When the gate 21 moves into its reset position as illustrated in FIGS. 1 and 2, the balls 41 will move outwardly and bear against the bevelled inside portion 40 of gate 21 thereby retaining the gate 21 in the untripped position and allowing normal operation of the engine to resume.

Many modifications to the invention will readily occur to those skilled in the art to which it relates and the embodiments herein described should be taken as illustrative of the invention only and not as limiting its scope as defined in accordance with the accompanying claims.

What is claimed is:

1. An engine air shutdown valve to close an air intake of an engine having a longitudinal axis, said valve comprising a housing, a gate movable relative to said housing from a first position wherein said air intake is open to a second position wherein said air intake is closed, said gate moving in a direction parallel to said longitudinal axis of said air intake, a retainer coaxial with said gate and being movable relative to said gate, a gate spring mounted between said housing and said gate and biasing said gate to move relative to said housing in a first locked position, means for maintaining said gate in said locked position, said gate maintaining means being movable between a first position wherein said gate is in said first locked position and a second position wherein said gate is released, means for releasing said gate maintianing means such that said gate separates from said housing under the influence of said gate spring, said retainer retaining said gate maintaining means in said second position when said gate closes said air intake.

2. An engine air shutdown valve as in claim 1 wherein said gate maintaining means comprises balls acting on said gate and a trip spindle movable relative to said housing, said balls moving under the influence of said trip spindle from a first position wherein said gate is maintained in its reset position to a second position wherein said gate is released from said reset position and moves to its activated position.

3. An engine air shutdown valve as claim 2 wherein said trip spindle has a shoulder which maintains said balls in said first position and a cylindrical recessed portion which allows said balls to release said gate.

4. An engine air shutdown valve as in claim 3 wherein said trip spindle is positioned within a keeper and further comprising a spindle spring mounted between said keeper and said trip spindle, said spindle spring acting to bias said trip spindle in a direction opposite to the bias of said gate spring.

5. An engine air shutdown valve as in claim 4 wherein said trip spindle is activated by a plunger acting on said trip spindle in a direction opposite to the bias of said spindle spring.

6. An engine air shutdown valve as in claim 4 wherein said trip spindle is activated by a solenoid acting on said trip spindle in a direction opposite to the bias of said spindle spring.

7. A method of shutting off a supply of air to an engine comprising the steps of:

(a) positioning a gate and a retainer in a first open position adjacent to the sealing face of an air flow passage of an engine having an air intake and applying a spring to bias said gate towards a position where said air intake is closed;

(b) maintaining said gate in said open position under the influence of a spindle;

(c) initiating downwards movement of said spindle thereby to release said gate and retainer so as to allow movement of said gate and retainer in a direction parallel to the axis of said air intake of said engine from said open to said closed position;

(d) terminating movement of said retainer and allowing said gate to move relative to said retainer following said termination of movement of said retainer while said retainer is stationary; and (e) allowing said gate to contact said sealing face and close said air intake.

8. An engine air shutdown valve to close an engine air intake comprising a housing, means for closing said air intake, said air intake having a longitudinal axis, means for moving said closing means relative to said housing and in a direction parallel to said longitudinal axis of said air intake of said engine from a first position wherein said air intake is open to a second position wherein said air intake is closed, means for maintaining said gate in said first position, means for releasing said maintaining means such that said gate separates from said housing under the influence of said moving means and moves to said second position and means for retaining said gate maintaining means when said gate is in said second position, said closing means being movable relative to said retaining means.

9. An engine air shutdown valve as in claim 8 and further comprising means for moving said gate from said closed to said open position.

* * * * *